US009620002B2

(12) United States Patent
Penisoara et al.

(10) Patent No.: US 9,620,002 B2
(45) Date of Patent: Apr. 11, 2017

(54) METHOD AND APPARATUS FOR SELECTING AT LEAST ONE DEVICE TO BE WIRELESSLY CONTROLLED

(75) Inventors: Nicusor Penisoara, Bucharest (RO); Razvan-Mihai Lucaci, Suceava (RO); Adrian-Ioan Nistor, Bucharest (RO)

(73) Assignee: NXP USA, INC., Austin, TX (US)

( * ) Notice: Subject to any disclaimer, the term of this patent is extended or adjusted under 35 U.S.C. 154(b) by 1145 days.

(21) Appl. No.: 13/203,298

(22) PCT Filed: Mar. 31, 2009

(86) PCT No.: PCT/IB2009/051350

§ 371 (c)(1),
(2), (4) Date: Aug. 25, 2011

(87) PCT Pub. No.: WO2010/112972

PCT Pub. Date: Oct. 7, 2010

(65) Prior Publication Data

US 2012/0007725 A1 Jan. 12, 2012

(51) Int. Cl.
*G08C 19/12* (2006.01)
*G08C 17/02* (2006.01)

(52) U.S. Cl.
CPC ..... *G08C 17/02* (2013.01); *G08C 2201/92* (2013.01)

(58) Field of Classification Search
CPC ..... G08C 17/02; G08C 2201/92
USPC ..... 340/4.11, 5.22, 5.61–5.63, 12.22, 13.24, 340/13.25, 13.36, 426.13, 815.6; 348/731, 732, 733, 734; 341/173, 176; 455/150.1, 151.1, 151.2, 151.4, 130, 352; 446/454
See application file for complete search history.

(56) References Cited

U.S. PATENT DOCUMENTS

| | | | | |
|---|---|---|---|---|
| 7,864,043 | B2 * | 1/2011 | Camp et al. | 340/539.13 |
| 2005/0035846 | A1 * | 2/2005 | Zigmond et al. | 340/5.22 |
| 2005/0094610 | A1 * | 5/2005 | de Clerq et al. | 370/338 |
| 2006/0197676 | A1 | 9/2006 | Smith | |
| 2008/0137631 | A1 * | 6/2008 | de Clerq et al. | 370/338 |
| 2008/0238661 | A1 * | 10/2008 | Camp et al. | 340/539.21 |

(Continued)

FOREIGN PATENT DOCUMENTS

| | | | |
|---|---|---|---|
| KR | 10-2009-0011298 | A | 2/2009 |
| WO | 2004/063765 | A1 | 7/2004 |

OTHER PUBLICATIONS

Bertinato M et al: "RF Localization and tracking of mobile nodes in Wireless Sensors Networks: Architectures, Algorithms and Experiments" DEI, Department of Information Engineering, University of Padua, Italy, pp. 1-17.

(Continued)

*Primary Examiner* — Sisay Yacob

(57) ABSTRACT

A method for selecting at least one device to be controlled by a radio frequency (RF) controller device is described. The method comprising arranging a plurality of controllable devices into a plurality of groups; determining at least one link quality value for at least one device associated with the plurality of groups; calculating a proximity factor for the plurality of groups of controllable devices based at least partly on the determined at least one link quality value; comparing proximity factors for the plurality of groups of and selecting the group of controllable devices comprising a favorable proximity factor to be controlled by the RF controller device.

3 Claims, 6 Drawing Sheets

(56) References Cited

U.S. PATENT DOCUMENTS

2009/0195407 A1* 8/2009 Nakano et al. ..... 340/825.69

OTHER PUBLICATIONS

Lee Hyung Su et al: "The Method of Location Error Detection and Correcting in Smart Home Environments" 2006 International Conference on Hybrid Information Technology (ICHIT'06), IEEEThe Computer Society, 2006, pp. 1-7.
International Search Report and Written Opinion correlating to PCT/IB2009/051350 dated May 30, 2011.

* cited by examiner

METHOD AND APPARATUS FOR SELECTING AT LEAST ONE DEVICE TO BE WIRELESSLY CONTROLLED

FIELD OF THE INVENTION

The field of the invention relates to a method and apparatus for selecting at least one device to be wirelessly controlled, and in particular to a method for selecting at least one device to be controlled by a radio frequency controller device, and a radio frequency controller device and a radio frequency control system arranged to perform said method.

BACKGROUND OF THE INVENTION

In the field of Radio Frequency (RF) remote controllers, it is known for such RF remote controllers to be paired with a plurality of devices to be controlled of the same type. For example, an RF remote controller may be paired with two or more television sets, the television sets being located in different rooms within, say, a residential building. Examples of other devices to which the RF remote controller may additionally/alternatively be paired with include, by way of example, DVD (Digital Versatile Disk) players, lighting systems, air conditioning systems, etc. Such RF remote controllers may be arranged to operate using IEEE 802.15.4 global standard RF protocols (http://www.ieee802.org/15/), such as the RF4CE (RF for Consumer Electronics) protocol currently being developed by the RF4CE consortium (www.rf4ce.org), and the applicant's SynkroRF™ entertainment control network protocol (www.freescale.com/synkro), etc.

Typically, at any given moment only one device of any given type may be selected and controlled by an input means of a user interface of the RF remote controller, such as appropriate buttons or keys. In order to select a different device of a certain type to that currently selected, a user of the RF remote controller is required to manually select the device that they wish to control via the user interface.

This need for a user to manually select the required device to be controlled can significantly degrade the user experience. For example, in a case where a user moves from, say, one room to another, it may be necessary for that user to change the selection of multiple types of devices (e.g. DVD player, television set, lighting system, etc.), resulting in a cumbersome experience for the user. Such a scenario is not just limited to when a user moves from one room to another, but may occur when a user moves from one area within, say, a room or other open space to another area within the same room or open space. For example, in a large room or hallway there may be devices located within different areas of the room or hallway.

SUMMARY OF THE INVENTION

The present invention provides a method for selecting at least one device to be controlled by a radio frequency controller device, a radio frequency controller device and a radio frequency control system arranged to perform said method as described in the accompanying claims.

Specific examples of the invention are set forth in the dependent claims.

These and other aspects of the invention will be apparent from and elucidated with reference to the examples described hereinafter.

BRIEF DESCRIPTION OF THE DRAWINGS

Further details, aspects and examples of the invention will be described, by way of example only, with reference to the drawings. Elements in the figures are illustrated for simplicity and clarity and have not necessarily been drawn to scale.

DETAILED DESCRIPTION OF THE PREFERRED EMBODIMENTS

Figure 1:
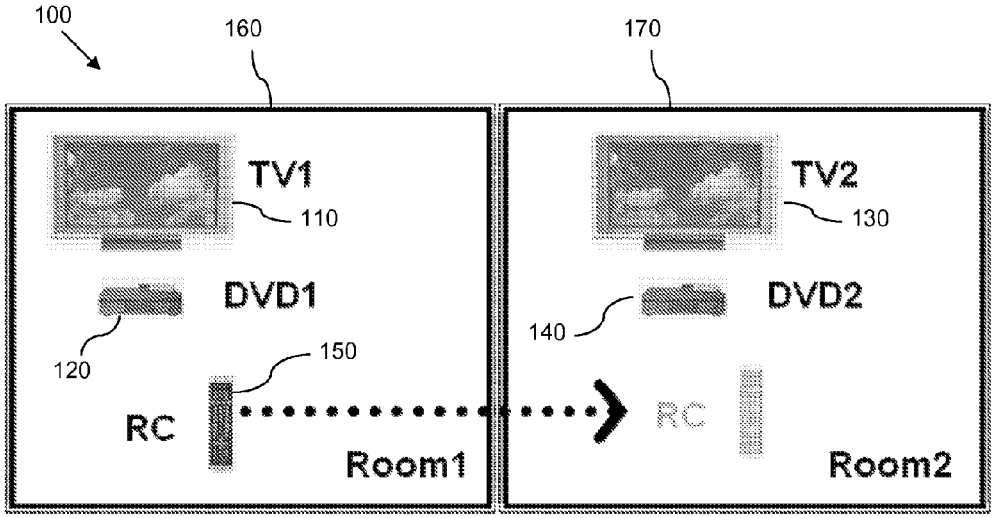
FIG. 1 illustrates an example of a radio frequency (RF) control system.

Referring now to FIG. 1, there is illustrated an example of a radio frequency (RF) control system 100. The RF control system 100 comprises a plurality of controllable devices 110, 120, 130, 140 and an RF controller device 150. For the illustrated example, the controllable devices comprise a first television set 110, and a first DVD (Digital Versatile Disk) player 120 located in a first location room 160, and a second television set 130 and a second DVD player 140 located in a second location room 170. The RF controller device 150 may comprise a universal/master remote control or the like. Thus, the RF control system 100 for the illustrated example comprises two controllable devices of a first type, namely the two televisions sets 110, 130, and two controllable devices of a second type, namely the two DVD players. The RF controller device 150 is paired with, or otherwise associated with, each of the first and second television sets 110, 130 and each of the first and second DVD players 120, 140. The RF control system 100 may comprise, and the RF controller device 150 may be paired with, other types of controllable devices, such as, by way of example only, music systems, lighting systems, air conditioning and/or heating systems, other home appliances and/or home entertainment devices, etc. The RF control system 100 may be arranged to operate using any suitable RF protocol, for example an IEEE 802.15.4 global standard RF protocol, such as the new RF4CE (RF for Consumer Electronics) protocol currently being developed by the RF4CE consortium (www.rf4ce.org), or the applicant's SynkroRF™ entertainment control network protocol (www.freescale.com/synkro). Alternatively, such an RF control system may be based on other wireless protocols, such as Bluetooth™ (see www.bluetooth.com).

Figure 2:
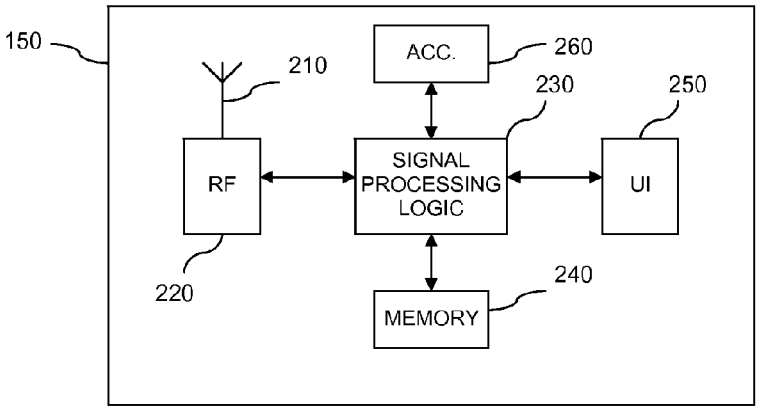
FIG. 2 illustrates an example of a simplified block diagram of an RF controller device.

Referring now to FIG. 2, there is illustrated an example of a simplified block diagram of the RF controller device 150 of FIG.1. Because the various components of the RF controller device 150 required for explaining and implementing the present invention are, for the most part, composed of electronic components and circuits known to those skilled in the art, circuit details will not be explained in any greater extent than that considered necessary for the understanding and appreciation of the underlying concepts of the invention and in order not to obfuscate or distract from the teachings of the present invention. Furthermore, and as will be appreciated by those skilled in the art, various components and elements of the RF controller device 150 have been omitted from FIG. 2 in order also not to obfuscate or distract from the teachings of the present invention.

For the illustrated example, the RF controller device 150 comprises RF circuitry 220 operably coupled to an antenna 210 and arranged to transmit and in some examples, receive RF signals to and from controllable devices, such as the controllable devices 110, 120, 130, 140 illustrated in FIG. 1. The RF controller device 150 further comprises signal processing logic 230 operably coupled to the RF circuitry 220, and a user interface (UI) 250. The signal processing logic 230 may be arranged to transmit command signals to one or more of the controllable devices 110, 120, 130, 140 in response to inputs received via the user interface 250. In this manner, a user of the RF controller device 150 is able to control a controllable device 110, 120, 130, 140 by way of the user interface 250 of the RF controller device 150. The signal processing logic 230 may additionally or alternatively be arranged to transmit command signals to one or more of the controllable device 110, 120, 130, 140 substantially autonomously, for example periodically or in response to some event, such as detection of movement of the RF controller device 150 or the like. Alternatively, the signal processing logic 230 may additionally or alternatively be arranged to use a wireless local loop (WLL) arrangement to communicate command signals to one or more of the controllable devices 110, 120, 130, 140, substantially autonomously.

Typically, at any given moment, only one controllable device of any given type may be selected and controlled by an input means of a user interface of the RF controller device 150, for example by way of pressing one or more appropriate buttons or keys. For known RF remote controller devices, in order to select a different device of a certain type to that currently selected, a user of the RF remote controller device is required to manually select the device that they wish to control via a user interface of the RF remote controller device. As previously mentioned, such a need for a user to manually select the required device to be controlled can significantly degrade the user experience.

Figure 3:
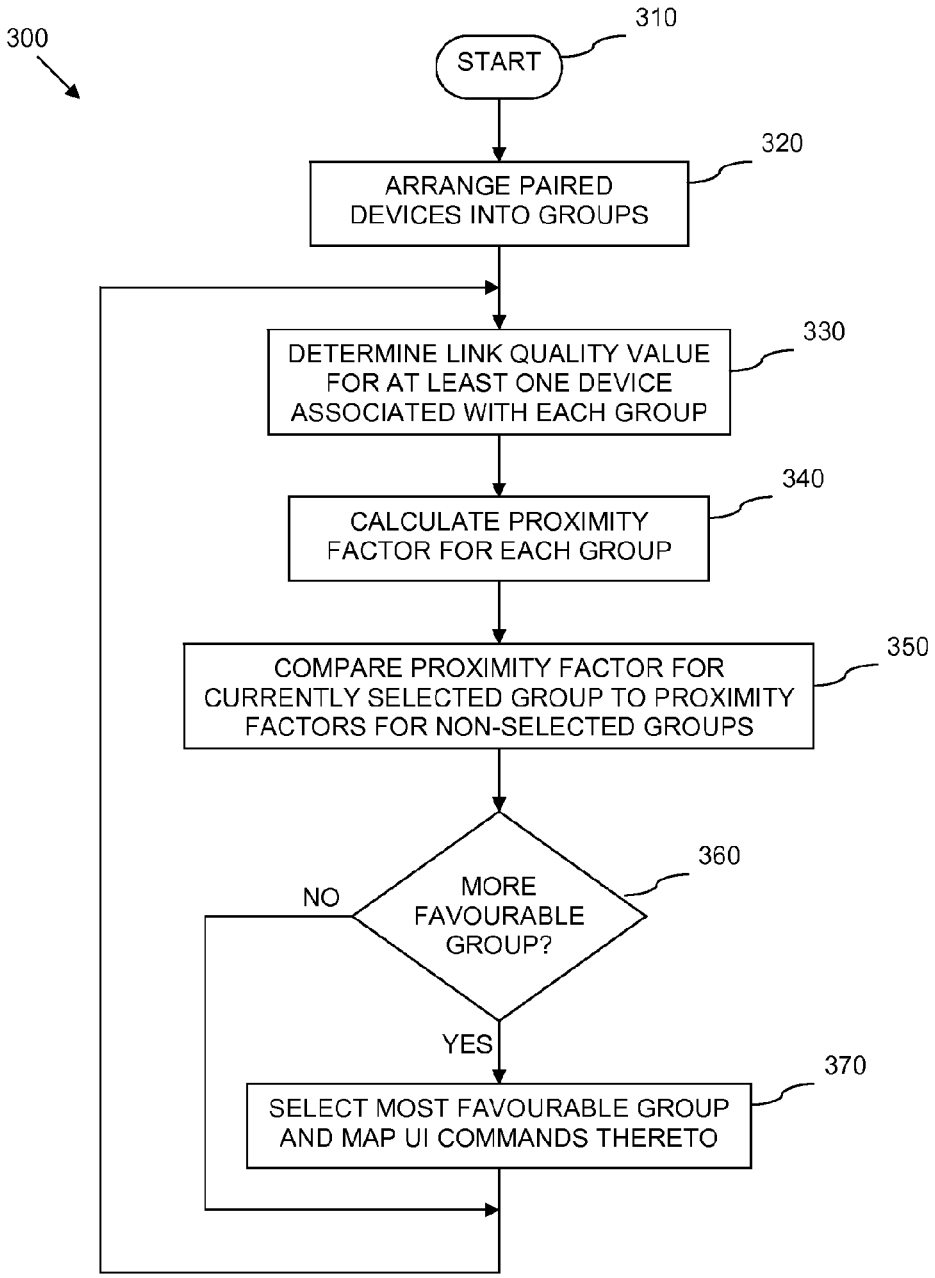
FIG. 3 illustrates an example of a simplified flowchart of a method for selecting at least one device by a radio frequency (RF) controller device.

Referring now to FIG. 3, there is illustrated an example of a simplified flowchart 300 of a method for selecting at least one controllable device to be controlled by a radio frequency (RF) controller device. For example, the signal processing logic 230 of FIG. 2 may be arranged to implement the method of FIG. 3, such as by way of executing computer-readable code stored in memory 240.

The method starts at step 310, and moves to step 320 where controllable devices are arranged into groups. For example, for the RF controller device 150 of FIG. 2, the signal processing logic 230 may be arranged or configured to associate each of the controllable devices 110, 120 in the first location 160 with a first group ("Room1") and the controllable devices 130, 140 in the second location 170 with a second group ("Room2"). Each controllable device may be associated with at least one group upon being paired, or otherwise associated, with the RF controller device 150. Next, in step 330, link quality values for at least one device associated with each group may be determined. A proximity factor for each group of controllable devices may then be calculated based at least partly on the determined link quality values as shown in step 340. The proximity factor for a currently selected group of controllable devices is then compared with proximity factors for non-selected groups of controllable devices in step 350. If at least one non-selected group of controllable devices comprises a proximity factor more favourable than the proximity factor of the currently selected group, in step 360, the method moves on to step 370 where the group of controllable devices comprising the most favourable proximity factor is selected to be controlled by the RF controller device. For example, upon selection of a group of controllable devices, commands received via the user interface 250 of the RF controller device 150 may be mapped to the controllable devices of the currently selected group. For the illustrated example, the method then loops back to step 330. In this manner, the process may be periodically repeated.

Referring back to step 360, if no non-selected group of controllable devices comprises a proximity factor more favourable than the proximity factor of the currently selected group, the method loops, for the illustrated example, straight back to step 330.

In this manner, the RF controller device 150 of FIG. 2 is able to automatically select a group of controllable devices to which commands are to be sent based at least partly on proximity factors for the various groups of controllable devices, which in turn may be based at least partly on link quality values for devices associated with the various groups (as described in greater detail below). Accordingly, the RF controller device 150 of FIG. 2 is able to automatically select the most suitable group of devices for its current situation, such as the group of devices generally located nearest to it.

For example, referring back to FIG. 1, the RF controller device 150 may initially be located in the first location 160. Accordingly, due to their close proximity to the RF controller device 150, the "Room1" group of controllable devices, namely the first television set 110 and the first DVD player 120, will typically comprise superior link quality values as compared with those of the "Room2" group of controllable devices, namely the second television set 130 and the second DVD player 140. Thus, the "Room1" group of controllable devices will typically comprise a more favourable proximity factor than that of the "Room2" group of controllable devices, and will therefore typically be selected by the RF controller device 150. By selecting the "Room1" group of controllable devices, the RF controller device 150 is able to map commands from the user interface thereof to the controllable devices of the "Room1" group. In this manner, a user of the RF controller device 150 is able to control the first television set 110 and the first DVD player 120 using the user interface of the RF controller device 150, without having to select the particular device.

If the RF controller device 150 subsequently moves from the first location 160 to the second location 170, the link quality for the "Room1" group of controllable devices will decrease whilst the link quality for the "Room2" group of controllable devices will increase as the RF controller device 150 moves from the first location 160 to the second location 170. As a result, the proximity factors for the "Room1" and "Room2" groups of controllable devices will also change, until the proximity factor for the "Room2" group of controllable devices becomes more favourable than that of the "Room1" group of controllable devices. At this point, the RF controller device 150 may automatically select the "Room2" group of controllable devices instead of the "Room1" group of controllable devices. As a result, the RF controller device 150 is now able to map commands from the user interface thereof to the controllable devices of the "Room2" group. In this manner, when a user of the RF controller device 150 moves from the first location 160 to the second location 170, taking the RF controller device 150 with them, the user is able to control the second television set 130 and the second DVD player 140 using the user interface of the RF controller device 150 substantially without the need to perform any manual configuration or perform any device selection operations.

The above mentioned automatic selection of the most suitable group of devices by the RF controller device 150 may, thus, simplify user interaction with the RF controller device 150, and may improve the overall user experience.

As previously mentioned, link quality values for at least one device associated with each group of controllable devices may be determined, and based upon which a proximity factor for each group may be calculated. Such a link quality value typically comprises an expression of the quality of received data from the respective device. For example, the link quality value may be derived from, say, a received RF signal power level for the respective device, whereby a superior link quality may comprise a higher value. Alternatively such a link quality value may be derived from a bit error rate or similar error indicator, whereby a superior link quality may comprise a lower bit error value. One example of a potentially suitable link quality value is a link quality indicator (LQI), which is typically directly influenced by the signal power at the receiver antenna and the interference present on the channel, and which in some examples may be reported with each received packet. However, it will be appreciated that the link quality value for a device may be derived from alternative measurements or use of alternative parameters, etc.

The proximity factor for a group of controllable devices may be calculated based on the respective link quality value(s) using any suitable algorithm or scheme. For example, the proximity factor for a group of controllable devices may be calculated by determining an average link quality value for one or more devices associated with that group. In this manner, the group of controllable devices having the more favourable proximity factor may be the group comprising controllable devices having the highest (or lowest) average link quality value. Alternatively, the proximity factor for a group of controllable devices may be calculated based on filtering the link quality values for the received packets from one or more devices associated with that group. In this manner, link quality values may be accumulated over time and processed using suitable rules to determine a proximity factor. A further alternative example comprises assigning weighting factors to the link quality values depending on the type of device to which the link quality value relates (e.g. television, DVD, lighting, window blinds, etc.). In this manner, the group of controllable devices having the more favourable proximity factor may be the group having the highest (or lowest) average weighted link quality value.

As also previously mentioned, if at least one non-selected group of controllable devices comprises a proximity factor that is more favourable than the proximity factor of the currently selected group, the group of controllable devices comprising the most favourable proximity factor is selected to be controlled by the RF controller device. If the RF controller device is situated in a location whereby the proximity factors for two groups of controllable devices are substantially equal, the situation may occur whereby the selection of a group of controllable devices to control may vacillate between these two groups. In order to avoid such a situation, it is contemplated that a new group of controllable devices is selected if at least one non-selected group comprises a proximity factor exceeding the proximity factor of the currently selected group by more than a threshold amount. Thus, the requirement for the proximity factor of a non-selected group to exceed that of the selected group by a threshold amount is used to provide stability to the selection process, thereby enabling the potential problem of the selection of a group of devices to control vacillating between two (or more) groups to be substantially alleviated.

Figure 4:
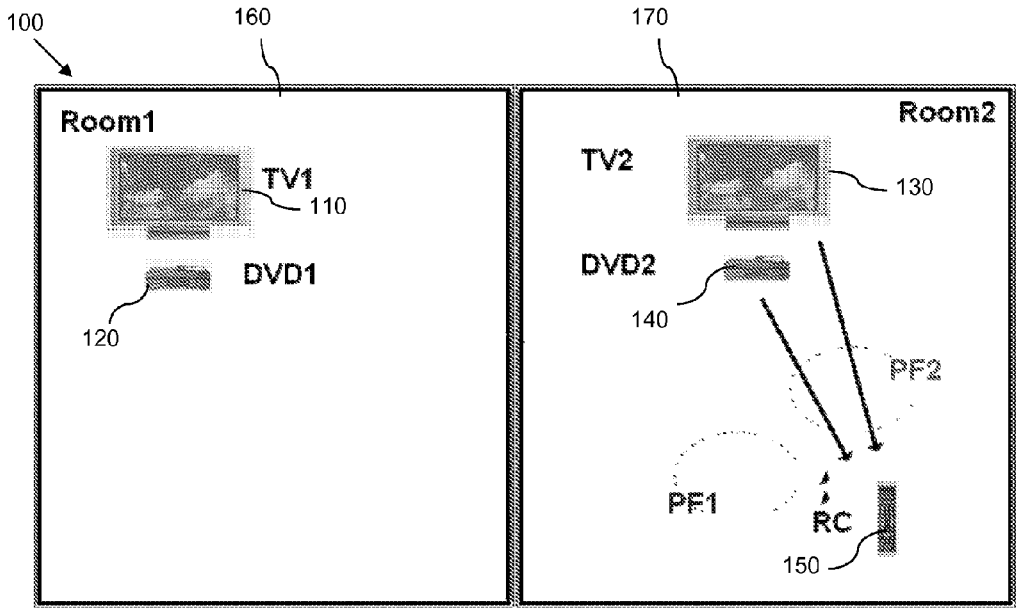
FIGS. 4 to 6 illustrate alternative examples of the RF control system of FIG. 1.

Referring now to FIG. 4, there is illustrated a further example of the RF control system 100 of FIG. 1. For the example illustrated in FIG. 4, the proximity factor for each group of controllable devices is calculated based on link quality values for substantially all controllable devices within that group. Thus, for the illustrated example the proximity factor (PF1) for the "Room1" group of controllable devices is calculated based on link quality values for the first television set 110 and the first DVD player 120. Similarly, the proximity factor (PF2) for the "Room2" group of controllable devices is calculated based on link quality values for the second television set 130 and the second DVD player 140. In this manner, by calculating the proximity factor for a group based on all controllable devices within that group, a substantially accurate representation for the proximity of the overall group may be achieved.

Figure 5:
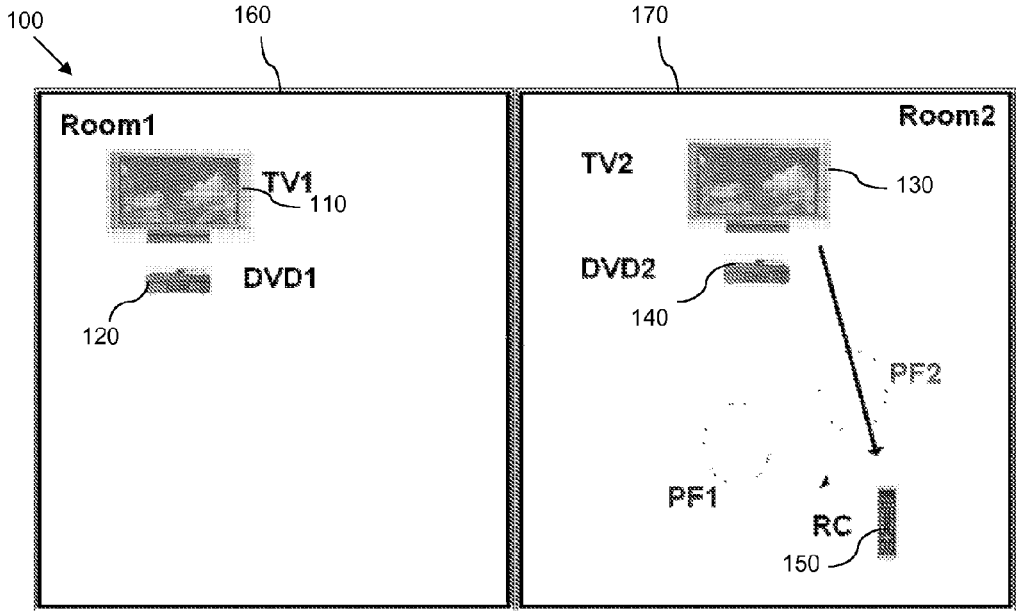

Referring now to FIG. 5, there is illustrated a yet further example of the RF control system 100 of FIG. 1. For the example illustrated in FIG. 5, the proximity factor for each group of controllable devices is calculated based on link quality values for a sub-set of controllable devices within that group. For example, one or more controllable devices within each group may be identified within the memory 240 of the RF controller device 150 of FIG. 2, for example by a user thereof, as devices where the link quality values may be used for calculating the proximity factor for that group. For the example illustrated in FIG. 5, the proximity factor for each group of controllable devices is calculated based on a link quality value of a single controllable device within that group. In particular, the proximity factor (PF1) for the "Room1" group of controllable devices is calculated based on a link quality value for the first television set 110, and the proximity factor (PF2) for the "Room2" group of controllable devices is calculated based on a link quality value for the second television set 130. In this manner, the RF controller device 150 is not required to determine a large number of link quality values, and the calculation of the proximity factors for the various groups may be simplified. In addition, in this example not all controllable devices need to be capable of up-link communication with the RF controller device 150.

Figure 6:
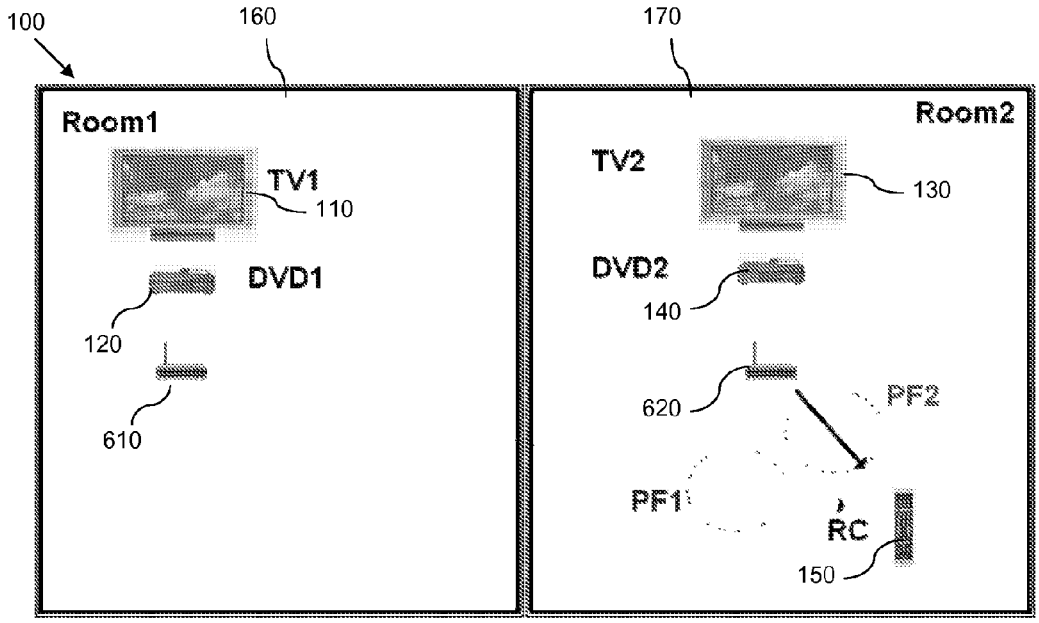

Referring now to FIG. 6, there is illustrated a still further example of the RF control system 100 of FIG. 1. For the example illustrated in FIG. 6, the proximity factor for a group of controllable devices is calculated based on a link quality value for a proximity indication device associated with that group. Accordingly, for the illustrated example, a first proximity indication device 610 is located within the first location 160, and is associated with the "Room1" group of controllable devices. Similarly, a second proximity indication device 620 is located within the second location 170, and is associated with the "Room2" group of controllable devices. The RF controller device 150 is thus arranged to determine a link quality value for each of the first and second proximity indication devices 610, 620, and to calculate the proximity factors (PF1 & PF2) for the "Room1" and "Room2" groups of controllable devices based on the link quality value for the respective proximity indication device 610, 620 associated therewith. In this manner, the specific location of the controllable devices 110, 120, 130, 140 does not impact on the selection of a group of controllable devices by the RF controller device 150. Instead, the proximity indication devices 610, 620 may be located in positions that substantially optimise the selection of their respective group of controllable devices. Furthermore, in this example, none of the controllable devices need to be capable of up-link communication with the RF controller device 150.

It is contemplated that, upon selecting a new group of controllable devices, parameters for the controllable devices within that group may be obtained from, for the embodiment illustrated in FIG. 6, the proximity indication device 610, 620 associated with that group. For example, when the RF controller device 150 moves into the second location 170, and automatically selects the "Room2" group of controllable devices, the RF controller device 150 may obtain from the proximity indication device 620 associated with that group, or from one or more of the controllable devices themselves, command parameters for the controllable devices within that group. In this manner, the RF controller device 150 need only store command parameters for one group of controllable devices. Furthermore, if the RF controller device is lost and subsequently replaced, or if an additional RF controller device is introduced into the control system 100, there is no need for the replacement or additional RF controller device to be re-programmed with the various command parameters for all (or any) of the controllable devices within the control system.

Figure 7:
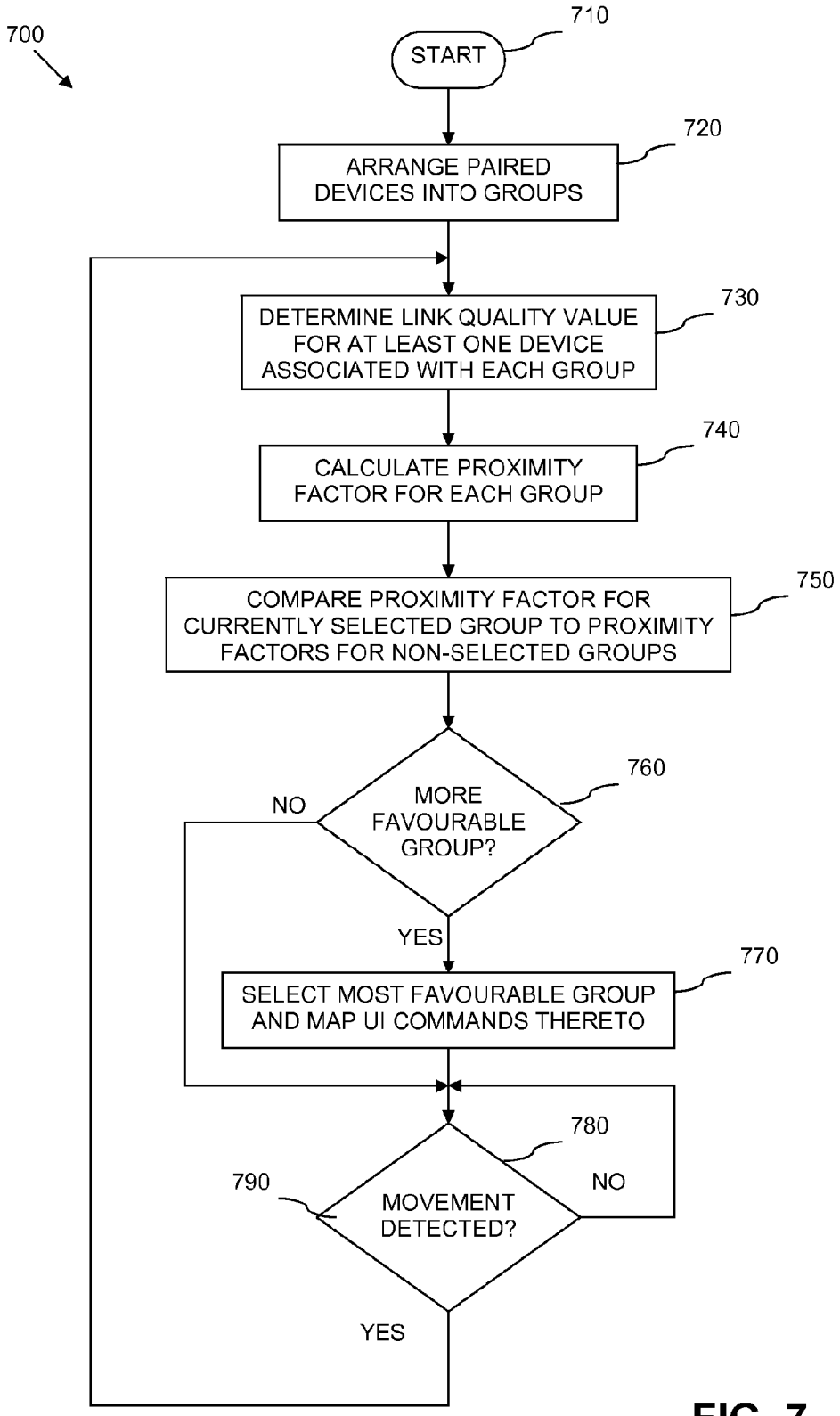
FIGS. 7 and 8 illustrate alternative examples of simplified flowcharts of a method for selecting at least one controllable device by a radio frequency (RF) controller device.

Referring now to FIG. 7 there is illustrated a further example of a simplified flowchart 700 of a method for selecting at least one controllable device to be controlled by a radio frequency (RF) controller device. For example, the signal processing logic 230 of the RF controller device 150 of FIG. 2 may be arranged to implement the method of FIG. 7, such as by way of executing computer-readable code stored in memory 240 thereof.

The method starts at step 710, and moves to step 720 where controllable devices are arranged into groups. Next, in step 730, link quality values for at least one device associated with each group are determined. A proximity factor for each group of controllable devices may then be calculated based at least partly on the determined link quality value as shown in step 740. The proximity factor for a currently selected group of controllable devices may then be compared with proximity factors for non-selected groups of controllable devices in step 750. If at least one non-selected group of controllable devices comprises a proximity factor more favourable than the proximity factor of the currently selected group, in step 760, the method moves on to step 770 where the group of controllable devices comprising the most favourable proximity factor is selected to be controlled by the RF controller device. The method then moves on to step 780. Referring back to step 760, if no non-selected group of controllable devices comprises a proximity factor more favourable than the proximity factor of the currently selected group, the method moves straight to step 780. At step 780, it is determined whether movement of the RF controller device has been detected, for example by way of an accelerometer 260 in the example illustrated in FIG. 2. If no movement has been detected, the method loops back to step 780. If movement is detected, the method loops back to step 730. In this manner, after an initial selection of a group of controllable devices, the steps performed in determining whether a non-selected group comprises a proximity factor more favourable than the proximity factor of the currently selected group (namely steps 730 to 770) are initiated upon detection of movement of the RF controller device. In this manner, during periods when the RF controller device is not moving, battery power and processing resources, etc. are not being needlessly used up in performing such actions.

Figure 8:
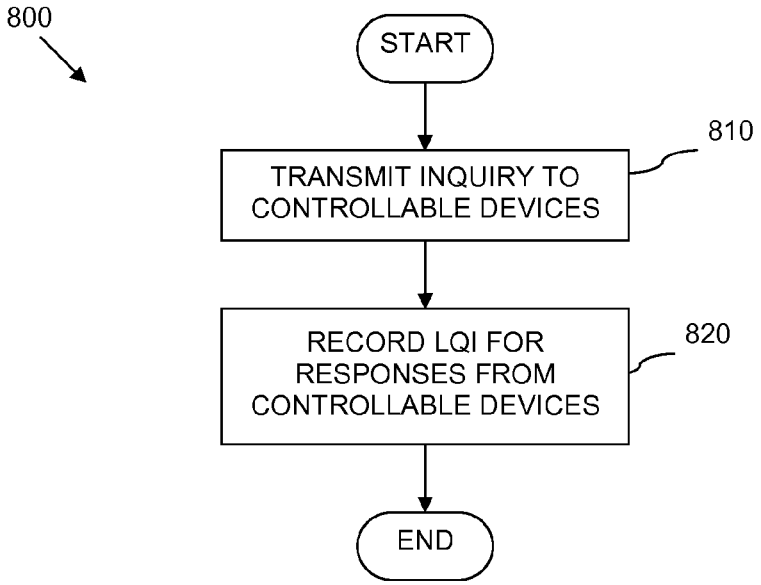

It is contemplated that for some examples, link quality values may be determined based on substantially regular or periodic transmissions from the at least one device associated with each group. For example each controllable device, or for the example illustrated in FIG. 6 each proximity indication device 610, 620, may be arranged to repeatedly transmit regular RF signals revealing their presence at a common output power level. In this manner, the RF controller device is able to use such regularly transmitted RF signals to determine the link quality values for the respective devices, without having to initiate or request such transmissions. Alternatively, and as illustrated in FIG. 8, the step 330 of FIG. 3, 730 of FIG. 7 of determining link quality values for at least one device associated with each group may comprise transmitting an enquiry (as illustrated at 810), and determining the link quality values for the at least one device associated with each group based on any response received to the enquiry (as illustrated at 820). The feature of the controllable device transmitting a regular RF signal to reveal its presence at a common output power level, or of the controllable device responding to an enquiry from the transmitted by the controller device, may be implemented by way of a network function that may be enabled or disabled as required within that device. In this manner, the primary functionality of such a device need not explicitly be aware of this function being enabled.

The signal processing logic 230 may additionally or alternatively be arranged to transmit command signals to one or more of the controllable devices 110, 120, 130, 140 substantially autonomously, for example periodically or in response to some event, such as detection of movement of the RF controller device 150 or the like. By way of example, the signal processing logic 230 may be arranged to transmit command signals to one or more of the controllable devices 110, 120, 130, 140 upon detection of the RF controller device 150 having moved from one location to another. Upon detection of such an event, the signal processing logic 230 may then be arranged to execute a user predefined set of commands, such as switching on lights located within the new location etc. The invention may also be implemented in a computer program for running on a programmable apparatus, such as signal processing logic 230, at least including code portions for performing steps of a method according to the invention when run on a programmable apparatus, or enabling a programmable apparatus to perform functions of a device or system according to the examples of the invention. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a programmable apparatus. The computer program may comprise a computer program product loadable in a memory of a programmable apparatus, which computer program product includes program code portions for executing one or more steps of the method according to the invention. The computer program may be provided on a data carrier, such as a CD-rom or diskette, stored with data loadable in a memory of a computer system, the data representing the computer program. The data carrier may further be a data connection, such as a telephone cable or a wireless connection.

In the foregoing specification, the invention has been described with reference to specific examples of embodiments of the invention. It will, however, be evident that various modifications and changes may be made therein without departing from the broader spirit and scope of the invention as set forth in the appended claims. For example, the connections may be any type of connection suitable to transfer signals from or to the respective nodes, units or devices, for example via intermediate devices. Accordingly, unless implied or stated otherwise the connections may for example be direct connections or indirect connections.

The conductors as discussed herein may be illustrated or described in reference to being a single conductor, a plurality of conductors, unidirectional conductors, or bidirectional conductors. However, different examples may vary the implementation of the conductors. For example, separate unidirectional conductors may be used rather than bidirectional conductors and vice versa. Also, plurality of conductors may be replaced with a single conductor that transfers multiple signals serially or in a time multiplexed manner. Likewise, single conductors carrying multiple signals may be separated out into various different conductors carrying subsets of these signals. Therefore, many options exist for transferring signals.

The term "program," as used herein, is defined as a sequence of instructions designed for execution on a computer system. A program, or computer program, may include a subroutine, a function, a procedure, an object method, an object implementation, an executable application, an applet, a servlet, a source code, an object code, a shared library/dynamic load library and/or other sequence of instructions designed for execution on a computer system.

It is to be understood that the architectures depicted herein are merely exemplary, and that in fact many other architectures can be implemented which achieve the same functionality. Furthermore, those skilled in the art will recognize that boundaries between the functionality of the above described operations merely illustrative. The functionality of multiple operations may be combined into a single operation, and/or the functionality of a single operation may be distributed in additional operations. Moreover, alternative examples may include multiple instances of a particular operation, and the order of operations may be altered in various other examples. Furthermore, the devices may be physically distributed over a number of apparatuses, while functionally operating as a single device. Also, devices functionally forming separate devices may be integrated in a single physical device. However, other modifications, variations and alternatives are also possible.

Also, the invention is not limited to physical devices or units implemented in non-programmable hardware but can also be applied in programmable devices or units able to perform the desired device functions by operating in accordance with suitable program code. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The invention claimed is:

1. A method for selecting at least one device to be controlled by a radio frequency (RF) controller device, the method comprising:

determining a first link quality value for a first device associated with a first group of a plurality of groups, each group of the plurality of groups having one or more controllable devices;

determining a second link quality value for a second device associated with a second group of the plurality of groups;

calculating a first proximity factor for the first group based at least partly on the determined first link quality value;

calculating a second proximity factor for the second group based at least partly on the determined second link quality value;

comparing the first and second proximity factors;

based on the comparing, selecting the first group to be controlled by the RF controller device over the second group in response to the first group having a more favourable proximity factor than the second group; and subsequent to selecting the first group, selecting a different group of the plurality of groups in response to the different group having a proximity factor that is more favourable by more than a threshold amount than the proximity factor of the currently selected first group.

2. An integrated circuit for a radio frequency (RF) controller device comprising:

signal processing logic arranged to arrange a plurality of controllable devices into a plurality of groups, determine a first link quality value for a first controllable device associated with a first group of the plurality of groups, determine a second link quality value for a second controllable device associated with a second group of the plurality of groups, calculate a first proximity factor for the first group based at least partly on the determined first link quality value, calculate a second proximity factor for the second group based on the determined second link quality value, compare the first and second proximity factors, select the first group to be controlled by the RF controller device over the second group based on the comparison indicating that the first group has a more favourable proximity factor than the second group, and subsequent to selection of the first group over the second group select a different group of the plurality of groups in response to the different group having a proximity factor that is more favourable by more than a threshold amount than the proximity factor of the currently selected first group.

3. A radio frequency (RF) control system comprising:

a plurality of controllable devices; and an RF controller device, the RF controller device comprising RF circuitry arranged to transmit and receive RF signals to and from controllable devices, and signal processing logic operably coupled to the RF circuitry;

wherein the signal processing logic is arranged to arrange the plurality of controllable devices into a plurality of groups, determine a first link quality value for a first controllable device associated with a first group of the plurality of groups, determine a second link quality value for a second controllable device associated with a second group of the plurality of groups, calculate a first proximity factor for the first group based at least partly on the determined first link quality value, calculate a second proximity factor for the second group based on the determined second link quality value, compare the first and second proximity factors, select the first group to be controlled by the RF controller device over the second group based on the comparison indicating that the first group having a more favourable proximity factor than the second group, and subsequent to selection of the first group over the second group select a different group of the plurality of groups in response to the different group having a proximity factor that is more favourable by more than a threshold amount than the proximity factor of the currently selected first group.

* * * * *